United States Patent [19]

Maldonado

[11] 4,258,262

[45] Mar. 24, 1981

[54] HIGH-POWER X-RAY SOURCE

[75] Inventor: Juan R. Maldonado, Berkeley Heights, N.J.

[73] Assignee: Bell Telephone Laboratories, Incorporated, Murray Hill, N.J.

[21] Appl. No.: 35,472

[22] Filed: May 3, 1979

[51] Int. Cl.[3] ..... H05G 1/02

[52] U.S. Cl. ..... 250/419

[58] Field of Search ..... 250/419, 420; 313/330

[56] References Cited

U.S. PATENT DOCUMENTS 3,610,984 10/1971 Seki ..... 313/330

OTHER PUBLICATIONS

"An Improved Annular Shaped Electron Gun for an X-Ray Generator", Gaines, Nuclear Instruments and Methods, 126, 1975, pp. 99–101.

"Nuclear Reactor Engineering", Glasstone, Van Nostrand Co., 1967, pp. 380–381.

*Primary Examiner*—Craig E. Church

*Attorney, Agent, or Firm*—Lucian C. Canepa

[57] ABSTRACT

A high-power X-ray source comprises a stationary hollow metallic cone. X-rays are emitted from a portion of the surface of the inside of the cone in response to bombardment of the surface portion by electrons. By means of a unique diverter, a substantially uniform and turbulent flow of water characterized by nucleate boiling is established in the immediate vicinity of the outside surface of the cone to achieve highly efficient cooling thereof. As a result, reliable operation of an X-ray source at high power densities is realized.

3 Claims, 5 Drawing Figures

HIGH-POWER X-RAY SOURCE

BACKGROUND OF THE INVENTION

This invention relates to the generation of X-rays and, more particularly, to an X-ray source characterized by high power.

X-ray generators are utilized in a variety of applications of practical importance. One significant area in which such sources are employed is the field of X-ray lithography. An advantageous X-ray lithographic system utilized to make structures such as large-scale-integrated (LSI) semiconductor devices is described in *IEEE Transactions on Electron Devices,* Vol. ED-22, No. 7, July 1975, pages 429–433. In an attempt to increase the throughput of such an X-ray lithographic system, considerable effort has been directed at trying to develop more sensitive resist materials for utilization therein and, moreover, at trying to increase the power output of the X-ray generator included in such a system.

High-power X-ray sources including rotating water-cooled anodes are available for use in lithographic systems. However, maintenance and reliability considerations make this type of source unattractive for some lithographic applications. Accordingly, efforts by workers in the lithographic field have been directed at trying to devise a high-power X-ray source having a stationary anode and characterized by high stability, long lifetime and low maintenance. It was recognized that such a source, if available, could be, for example, the basis for a rugged production-type X-ray lithographic system exhibiting advantageous throughput properties.

SUMMARY OF THE INVENTION

Hence, an object of the present invention is a high-power X-ray source, having a stationary anode, especially adapted for use in an X-ray lithographic system.

Briefly, this and other objects of the present invention are realized in a specific illustrative X-ray source that comprises a metallic hollow-cone anode. Incident electrons are directed to bombard a portion of the inside surface of the cone. X-rays emitted therefrom are directed to irradiate an LSI mask which is positioned in spaced-apart relationship with respect to a device substrate coated with an X-ray-sensitive resist material. The cone is cooled by establishing along the outside surface thereof a turbulent and substantially uniform water flow characterized by nucleate boiling. In one particular emobidment, the cooling system includes a unique diverter structure that when placed in position over the anode directs the water flow in such a way as to insure efficient and uniform cooling of the electron-bombarded anode.

In one specific illustrative embodiment, applicant's inventive X-ray source comprises a hollow metallic cone, an electron source for bombarding a portion of the inside surface of the cone with electrons to cause the emission of X-rays therefrom, and a system for water cooling the outside surface of the cone, characterized in that the cooling system including the aforementioned diverter establishes a turbulent and substantially uniform flow of water along said cone to achieve nucleate boiling in the immediate vicinity of the outside surface of the cone during electron bombardment.

BRIEF DESCRIPTION OF THE DRAWING

A complete understanding of the present invention and of the above and other features thereof may be gained from a consideration of the following detailed description presented hereinbelow in connection with the accompanying drawing, in which.

DETAILED DESCRIPTION

For purposes of a specific illustrative example, emphasis herein will be directed to a particular embodiment of applicant's invention that comprises an X-ray source included in an X-ray lithographic system. But it is to be understood that a high-power source made in accordance with applicant's inventive principles is also adapted for use in a variety of other applications of practical importance including, for example, diffraction studies, radiography and tomography.

Figure 1:
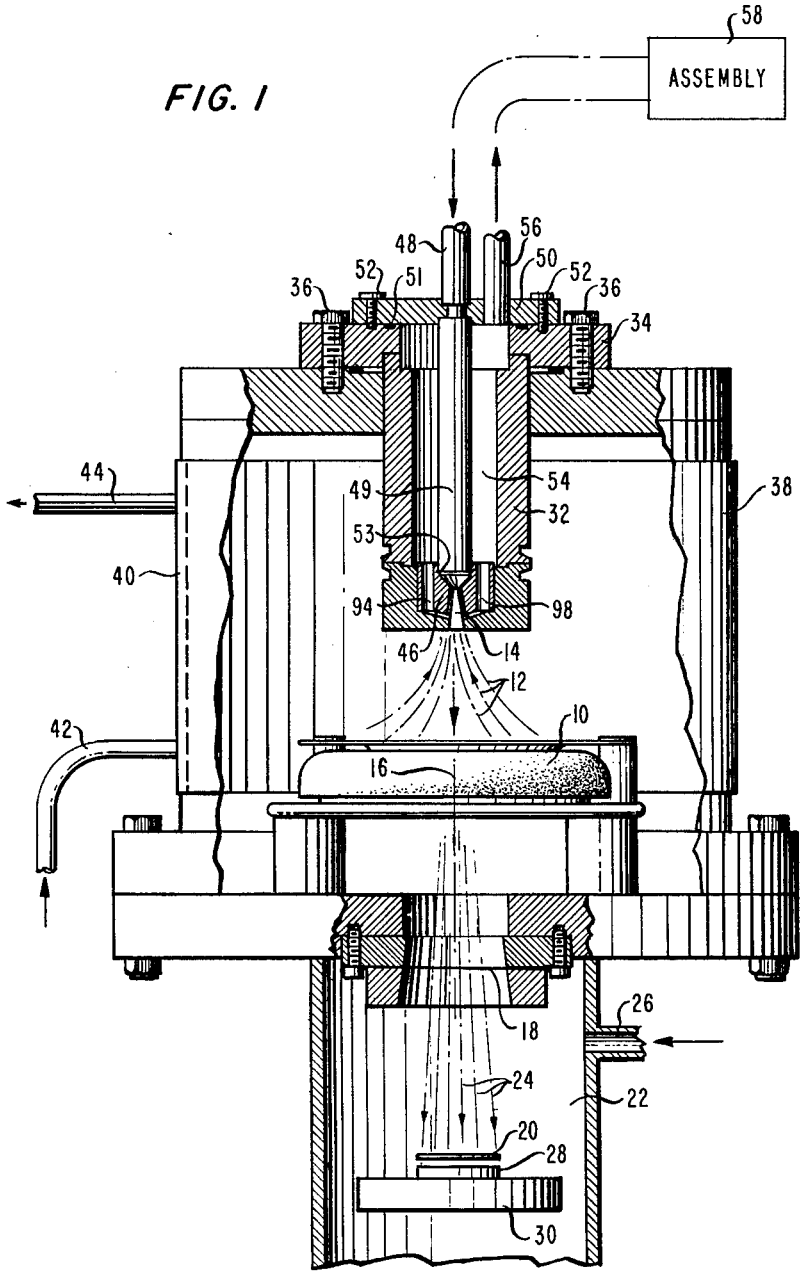
FIG. 1 is a schematic showing of a lithographic system that includes as a component thereof a specific illustrative X-ray generator made in accordance with the principles of the present invention.

In a generalized schematic way, FIG. 1 shows the major components of an X-ray lithographic system. An electron gun 10, whose structure and operation will be described later below in connection with FIG. 2, accelerates a beam of electrons, designated by dot-dash lines 12, towards a portion of the inside surface of a conical anode 14. In response to bombardment by electrons, the anode 14 emits X-rays which propagate downwards in FIG. 1, centered about longitudinal axis 16, through a beryllium window 18 to irradiate the upper surface of a conventional X-ray mask structure 20 mounted in a cylindrical exposure chamber 22. By way of a specific example, the chamber 22 is shown open at the bottom end thereof and, for example, contains therein a helium atmosphere at a pressure slightly in excess of atmospheric pressure. Helium gas is introduced into the chamber 22 via an inlet tube 26.

X-rays directed at the mask structure 20 of FIG. 1 are designated by reference numeral 24. The mask is shown positioned in spaced-apart relationship with respect to a substrate 28 whose top surface is coated with a layer of a standard X-ray-sensitive resist material. In turn, the resist-coated substrate is mounted on a conventional work table 30.

The anode 14 shown in FIG. 1 is mounted in a circular opening on the bottom surface of a cylinder 32 which includes an upper cylindrical flange portion 34. In turn, the flange portion 34 is secured by screws 36 to the upper surface of a cylindrical vacuum chamber 38. Illustratively, the pressure within the chamber 38 is maintained in the range $10^{-9}$ to $10^{-8}$ torr. Advantageously, the chamber 38 is constructed to include two spaced-apart walls that form between them a cooling jacket 40. Cooling of the chamber 38 is accomplished, for example, simply by circulating tap water through the jacket 40 via respective inlet and outlet pipes 42 and 44.

In accordance with a basic feature of the principles of the present invention, cooling of the anode 14 shown in FIG. 1 is carried out by directing a fluid such as water over the top surface of the anode. This is done in a precisely controlled manner by positioning a so-called diverter 46 to encompass a portion of the anode 14. Fluid is delivered to the diverter by means of an inlet pipe 48 that is mounted in a disc 50 which is secured to the flange portion 34 by screws 52. Advantageously, a seal is formed between the flange portion 34 and the disc 50 by interposing therebetween an O-ring 51.

Cooling fluid is directed downward over the top surface of the anode 14 of FIG. 1 via a tube 49 that constitutes an extension of the inlet pipe 48 within the chamber 54. The bottom end of the tube 49 is designed to fit into a cylindrically shaped recess portion formed in the top of the diverter 46. Advantageously, an O-ring 53 is utilized to establish a seal between the tube 49 and the diverter 46. Fluid directed through the diverter 46 then flows via an annular gap formed between the diverter and the bottom inside surface of the cylinder 32 upwards through multiple passageways formed in the diverter 46. The fluid then flows upwards through the main interior chamber 54 of the cylinder 32 and through an outlet pipe 56 mounted in the disc 50.

The inlet and outlet pipes 48 and 56 shown in FIG. 1 are connected to an assembly 58. The assembly 58 includes, for example, a pumping unit, a filter and a heat exchanger and reservoir unit. Although the assembly 58 is adapted to be utilized with a variety of cooling media (for example, liquids such as kerosene and ethylene glycol), it is generally advantageous to employ water therein because of the relatively good flow and thermal transfer properties of water and the ease of handling thereof.

In one specific illustrative embodiment of the principles of the present invention, the water flow in the anode cooling system schematically depicted in FIG. 1 was established at approximately 3.8- to 4 gallons per minute. The pressures in the inlet and outlet pipes 48 and 56 were maintained at about 160 and 75 pounds per square inch, respectively. For 4 kilowatts of input power delivered to the anode 14 by the electron source 10, the temperature of the water flowing in the inlet pipe 48 was measured to be approximately 15 degrees C and that in the outlet pipe 56 was approximately 38 degrees C.

In accordance with the teachings set forth in a commonly assigned concurrently filed application designated F. Vratny Ser. No. 035,473, a cooling system of the type described herein advantageously includes metallic parts made of a machineable high-chrome stainless steel such as those commonly designated type 304 or 316. Thus, for example, each of the fluid-wetted parts 32, 34, 46, 49, 50 and 56 shown in the drawing herein is advantageously made of such a material. In addition, in accordance with the teachings of the Vratny application, the O-rings 51 and 53 are advantageously made of Teflon synthetic resin polymer. (Teflon is a trademark of E. I. duPont de Nemours and Co.) In addition, in accordance with the teachings of th aforecited copending application, all other wetted surfaces in the cooling system (such as tubing, tubing sleeves and plugs) are advantageously made either of Teflon resin or of urethane, thereby to minimize contamination in the system.

Furthermore, as described in detail in the Vratny application, the filter included in the assembly 58 herein advantageously comprises a submicron-particle unit. Moreover, the Vratny application specifies various surface preparation, cleaning and maintenance procedures which when applied to the particular cooling system described herein contribute significantly to the overall design of a high-power X-ray source capable of reliable operation over an extended period of time. These procedures include, for example, initial preferential etching of the water-carrying surfaces of the metallic members and the addition of so-called complexing agents to the water to minimize the deposition of thin-film thermal barriers on the surface of the target anode.

Figure 2:
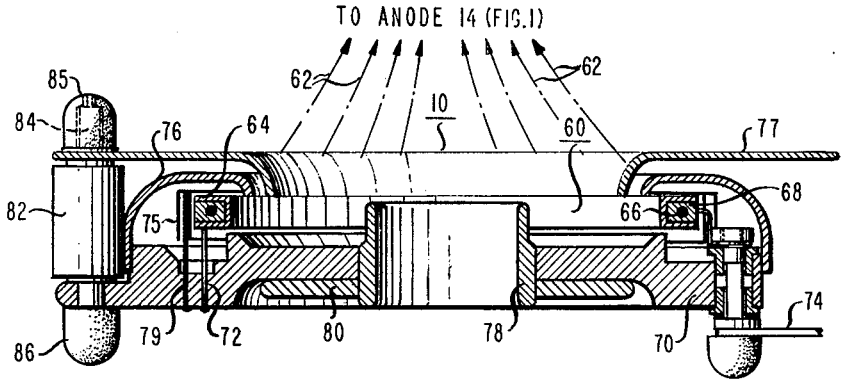
FIG. 2 depicts the details of an electron source included in the X-ray generator of FIG. 1.

A specific illustrative electron gun 10 of the type included in the FIG. 1 system described herein is shown in cross-section in FIG. 2. The depicted gun is similar in structure and function to the gun shown in FIG. 1 on page 99 of an article entitled "An Improved Annular-Shaped Electron Gun For An X-Ray Generator", by J. L. Gaines and R. A. Hansen, *Nuclear Instruments and Methods,* 126 (1975).

The FIG. 1 gun is designed to accelerate a hollow-cone electron beam to impinge upon a portion of the inner or lower surface of the anode 14 (FIG. 1). The trajectories of electrons emitted from cathode assembly 60 are schematically represented in FIG. 1 by dot-dash lines 62.

The cathode assembly 60 comprises a barium-impregnated annular tungsten cathode element 64 containing a molybdenum filament 66 retained in a high-temperature ceramic potting material 68. The assembly 60 is mounted on a molybdenum base plate 70 by means of a number of support pins 72 made of a tungsten rhenium alloy. Typically, two leads are connected to the filament 66, one lead being grounded and the other one extending to filament terminal 74 for connection to an external filament excitation source (not shown).

Advantageously, a three-sided annular shield 75 (FIG. 2) made, for example, of molybdenum is included in the electron gun 10 to encompass three sides of the cathode assembly 60. The shield 75 supported by plural molybdenum pins, one of which designated 79 is shown in FIG. 2, serves in effect as a heat retainer. This permits the filament 66 to be operated at a lower voltage than would be required in the absence of the shield. In practice, this has resulted in significantly increasing the lifetime of the filament.

The trajectories of electrons emitted from the cathode assembly 60 of FIG. 1 are determined by three annular beam-forming electrodes 76 through 78 and by varying the distance between the gun 10 and the target anode 14 (FIG. 1). The electrode or beam forming nose 78 is movable in a vertical direction and is retained in place by a nut 80. Movement of the electrode 78 and variation of the potential thereof are effective to change the trajectories of electrons emitted from the cathode assembly 60, to vary the size of the electron beam incident on the anode 14, and to control the magnitude of the electron beam current delivered to the anode.

In one specific illustrative embodiment of the electron gun shown in FIG. 2, the electrodes 76 and 77 and the cathode 64 were each maintained at a potential of −25 kilovolts. With respect to the cathode 64, the electrode 78 was capable of being established at a positive potential in the range 0-to-1 kilovolt. The voltage applied to the filament 66 was 15 volts. Such a gun was capable of delivering approximately 6 kilowatts of electron beam power to the anode 14 in the shape of a spot approximately 3 millimeters in diameter. Illustratively, the anode 14 was grounded.

Also included in the electron gun shown in FIG. 2 is a heat sink assembly that includes a beryllium oxide cylinder 82. The cylinder 82 is mounted in the depicted structure with a threaded stud 84 and nuts 85 and 86.

Figure 3:
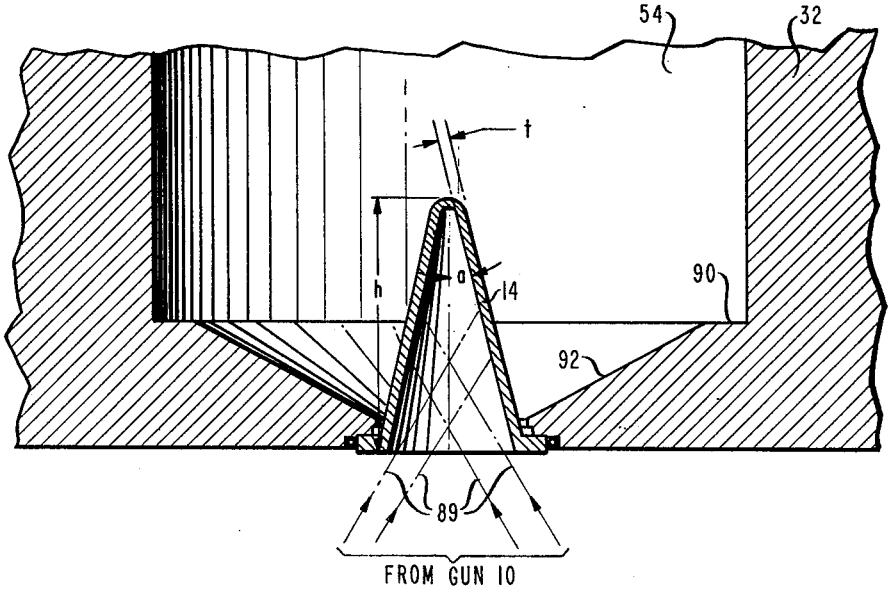
FIG. 3 illustrates a particular conical anode of the type included in the generator shown in FIG. 1.

A specific illustrative anode 14 of the type included in an X-ray generator made in accordance with applicant's invention is shown in FIG. 3. By way of example, the anode 14 comprises a cone made of a pure or substantially pure metal. The choice of material for the conical anode 14 determines the X-ray emission characteristic thereof. In one illustrative embodiment, the anode 14 of FIG. 3 comprises a cone of pure palladium having a wall thickness t in the range of 200 to 350 micrometers. The angle a shown in FIG. 3 was approximately 12.5 degrees C. The height h of the depicted cone was about 1.4 centimeters.

The conical target anode 14 shown in FIG. 3 is mounted, for example by brazing, in the bottom end of the previously described cylinder 32. As so mounted, the anode 14 extends into the chamber 54 depicted in FIG. 1. Cooling of the upper surface of the anode 14 is accomplished by flowing a cooling medium thereover, as will be described in detail below.

In FIG. 3, the trajectories of electrons emitted by the gun 10 of FIG. 2 and incident on a portion of the lower surface of the anode 14 are indicated by dot-dash lines 89. In the particular illustrative embodiment considered herein, the inner wall area of the anode 14 impacted by electrons approximated 0.33 square centimeters. The diameter of the projected spot is, however, about 3 millimeters.

In accordance with one feature of the principles of the present invention, a multi-apertured generally cylindrical diverter element is positioned near the bottom of the chamber 54 and symmetrically disposed about the anode 14. Specifically, the diverter element is adapted to rest on an annular ledge 90 shown in FIG. 3. When so positioned, the bottom surface of the diverter element is maintained spaced apart from the curved inclined surface 92 which constitutes the bottom of the chamber 54.

Figure 4:
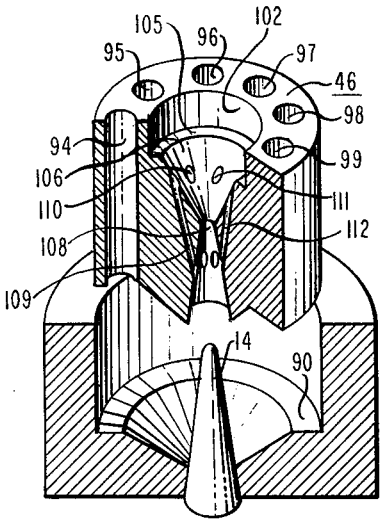
FIG. 4 represents a portion of a diverter element shown in spaced-apart relationship with respect to an associated conical anode.

A partially broken-away view of a specific illustrative diverter element 46 made in accordance with the principles of the present invention is shown in FIG. 4. The element 46 is depicted above and spaced apart from the anode 14, thereby to provide an exploded view of these normally mating parts. When the element 46 is mounted in its normal assembled position, peripheral portions of the bottom surface of the element 14 rest in contact with the ledge 90.

Illustratively, the generally cylindrical element 46 shown in FIG. 4 includes eight peripherally disposed outlet holes or channels. Six of these channels, designated 94 through 99, are indicated in FIG. 4. Two opposed ones 94 and 98 of the eight channels are indicated in FIG. 1.

During cooling of the anode 14, the aforespecified cooling fluid flows upwards through the channels represented in FIG. 4 and into the chamber 54 shown in FIG. 1. As indicated in FIG. 1, the cooling medium then flows via the outlet pipe 56 to the assembly 58. In turn, fluid flows from the assembly 58 via the inlet pipe 48 and tube 49 (see FIG. 1) into the top of the element 46 of FIG. 1. The bottom end of the tube 49 extends into a centrally positioned opening 102 in the top of the element 46. As indicated in FIG. 5, an O-ring 104 is interposed between the bottom end of the tube 49 and ledge 105 (FIG. 4) to effect a seal between the tube 49 and the diverter element 46.

Cooling fluid delivered to the diverter element 46 shown in FIG. 4 flows downward intp a conically shaped chamber 106 having a single opening 108 at the bottom end thereof and plural openings or channels formed in the sloping sidewall thereof. Illustratively, the chamber 106 contains six such sidewall openings. Four of these openings, designated 109 through 112, are indicated in FIG. 4.

Figure 5:
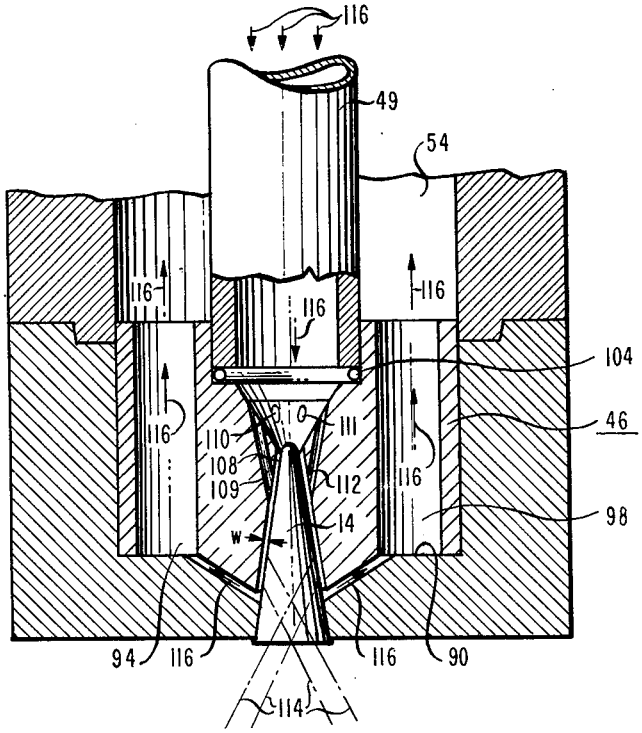
FIG. 5 shows the diverter element mounted in position with respect to the anode for directing a cooling medium over the back surface of the anode.

FIG. 5 shows the diverter element 46 in its normal assembled position resting on the ledge 90. As so positioned, the element 46 encompasses, but is spaced apart from, a major portion of the top surface of the anode 14. The spacing between the element 46 and the surface of the anode 14 constitutes a symmetrical channel through which the cooling medium is designed to flow.

A portion of the cooling fluid directed by the diverter element 46 over the anode 14 flows through the aforementioned bottom opening 108 formed in the element 46 (see FIGS. 4 and 5). The remaining portion of the cooling fluid flows through the aforespecified sidewall channels 109 through 112. As a result, a relatively uniform flow of cooling fluid is achieved over a major portion of the upper surface of the anode 14. The cooled surface of the anode overlies that portion of the lower surface thereof that is bombarded by electrons. The limits of the bombarded surface are indicated approximately in FIG. 5 by dot-dash lines 114.

The direction of flow of cooling fluid in FIG. 5 is shown by arrows 116. As indicated, fluid is delivered to the diverter element 46 via the tube 49 and, after progressing upwards through the channels 94, 98, is directed into the chamber 54. Intermediately, the fluid flows in a substantially uniform manner over a substantial portion of the upper surface of the anode 14 in the space defined between the diverter element 46 and the anode 14.

As specified earlier above, the pressures in the inlet and outlet pipes 48 and 56 (FIG. 1) are, illustratively, maintained at about 160 and 75 pounds per square inch, respectively. More generally, it is usually desirable to establish the input pressure as high as possible to maintain relatively high-velocity flow conditions along the upper surface of the anode 14. But, as the input pressure increases, the boiling point of the cooling medium also increases. And since in actual operation the temperature at the upper surface of the anode 14 remains substantially constant at approximately the boiling-point temperature, a practical limit is thereby set on the input pressure.

For the above-specified inlet pressure, the outlet pressure should be maintained at least about 60 pounds per square inch. If the outlet pressure falls much below that value, cavitation effects in the cooling medium may result. This in turn may lead to hot spots and a possible burn-out of the anode 14. In practice, it has been found that advantageous cooling conditions for the anode 14 are established if the ratio of input-to-output pressures in the herein-described illustrative structure is maintained in the range of about 2-to-2.5:1.

Moreover, in accordance with the principles of the present invention, the parameters of the depicted anode cooling arrangement are selected to establish a turbulent flow of the cooling medium. For turbulence to be established, the following condition must be satisfied $F/A_i > v/d$ where F is the flow of the cooling medium in gallons per minute, $A_i$ is the sum total in square inches of the areas of the outlets emanating from the conical chamber 106 (FIG. 4), and v and d are the viscosity and density, respectively, of the cooling medium.

In addition, in an anode cooling arrangement of the type described herein, the cooling medium flows through a so-called output channel as it leaves the immediate vicinity of the surface of the anode 14. In FIG. 5, that output channel constitutes an annulus having a width w. In accordance with a feature of the principles of the present invention, the area $A_o$ of the output channel is designed to be approximately equal to $A_i$. In that way, the velocity of the cooling medium along the entire extent of the cooled portion of the upper surface of the anode 14 is maintained relatively constant. As a result, the conditions for achieving uniform cooling of the anode without any cavitation effects are thereby enhanced.

In accordance with the principles of this invention, the cooling medium flowing in the particular illustrative anode cooling arrangement described above is characterized by nucleate boiling in the immediate vicinity of that portion of the surface of the anode 14 over which the medium flows. Near that surface, the cooling medium is superheated and tends to evaporate, forming bubbles wherever there are nucleation sites such as pits or scratches on the surface. These bubbles transport the latent heat of the phase change and also enhance convective heat transfer by agitating the medium near the surface.

A simple qualitative picture of the aforedescribed cooling process and of its effectiveness can be obtained by considering the amount of water evaporated in cooling the target 14 at 4 kilowatts electron input power and a 4 gallon per minute water flow. This amount, calculated from a water heat of vaporization of 500 calories per gram, is about 2 grams per second, which is less than one percent of the total flowing water (250 grams per second). And, because of the turbulence of the water flow, the boiling water bubbles are intermixed rapidly with the bulk of the cooling medium. Accordingly, formation of a layered vapor barrier (an insulating barrier) in the cooling medium is in practice effectively avoided.

Finally, it is to be understood that the abovedescribed arrangements are only illustrative of the principles of the present invention. In accordance with those principles, numerous modifications and alternatives may be devised by those skilled in the art without departing from the spirit and scope of the invention. For example, although primary emphasis herein has been directed to a conical anode 14 made entirely of palladium, it is also feasible in some applications of practical interest to make the anode of two different metals. Thus, for example, it may be advantageous to coat a lower inside portion of a palladium anode such as the one shown in FIG. 3 with a light metal such as beryllium. The portion so coated would be below the portion intended to be impacted by incident electrons from the gun 10. This would decrease the projected spot size by reducing X-ray emission stemming from secondary electrons hitting the anode outside the primary impacted area. In addition, it has been determined that the efficient cooling action described hereinabove also occurs if the aforespecified direction of water flow in the pipes 48 and 56 is reversed.

I claim:

1. In combination in a high-power X-ray source, a hollow metallic stationary cone, means for bombarding a portion of the inside surface of said cone with electrons to cause the emission of X-rays therefrom, and means for cooling the outside surface of said cone, CHARACTERIZED IN THAT said cooling means includes means for establishing a turbulent substantially uniform-velocity flow of a cooling medium along said cone to achieve nucleate boiling without cavitation effects in the immediate vicinity of the outside surface of said cone during electron bombardment, wherein said cone is mounted apex-up at the bottom of a closed cylindrical chamber defined by a casing, said casing having formed in the interior walls thereof an annular ledge portion that surrounds said cone at a height intermediate the apex and base thereof, wherein said establishing means comprises a substantially cylindrical diverter element resting on said ledge portion and encompassing, but spaced apart from, a major portion of the top surface of said cone, and wherein said diverter element is formed to include a centrally located through passageway symmetrically disposed with respect to the longitudinal axis of said element, said passageway comprising from top to bottom three separate joined compartments: a cylindrical compartment having an annular ledge portion at the bottom thereof, a conical apex-down compartment, and a conical apex-up compartment, said second-mentioned conical compartment being designed to encompass a major portion of said cone in spaced-apart relationship therewith, the sidewalls of said conical compartments including a symmetrical array of channels for uniformly distributing the cooling medium over a portion of the upper surface of said cone, said conical compartments including a channel therebetween symmetrically disposed with respect to the longitudinal axis of said diverter element for distributing the cooling medium over the apex of said cone, and said diverter element further being formed to include plural peripheral channels each extending through the entire longitudinal extent of said diverter element for carrying the cooling medium from said cone into said cylindrical chamber.

2. A combination as in claim 1 further including an inlet pipe extending into said cylindrical chamber, an O-ring interposed between the bottom end of said pipe and the ledge portion at the bottom of said cylindrical compartment, and an outlet pipe extending into said cylindrical chamber for carrying away the cooling medium that flows into said chamber from said cone via said peripheral channels.

3. A combination as in claim 2 wherein said inlet and oulet pipes are connected to an assembly that distributes water through said pipes as the cooling medium for said cone, the pressures in said inlet and outlet pipes being established by said cooling means to be approximately 160 and 75 pounds per square inch, respectively, and the flow through said pipes being established at approximately 4 gallons per minute.

* * * * *